US012059067B2

(12) United States Patent
Boatman-Tate

(10) Patent No.: US 12,059,067 B2
(45) Date of Patent: Aug. 13, 2024

(54) PORTABLE CADDY ORGANIZER

(71) Applicant: Wyconnda Boatman-Tate, Chicago, IL (US)

(72) Inventor: Wyconnda Boatman-Tate, Chicago, IL (US)

( * ) Notice: Subject to any disclaimer, the term of this patent is extended or adjusted under 35 U.S.C. 154(b) by 0 days.

(21) Appl. No.: 18/295,787

(22) Filed: Apr. 4, 2023

(65) Prior Publication Data

US 2023/0240433 A1 Aug. 3, 2023

Related U.S. Application Data

(60) Provisional application No. 63/334,087, filed on Apr. 23, 2022.

(51) Int. Cl.
*A45D 44/02* (2006.01)
*A45D 20/12* (2006.01)

(52) U.S. Cl.
CPC ..... *A45D 44/02* (2013.01); *A45D 20/12* (2013.01); *A45D 2020/126* (2013.01)

(58) Field of Classification Search
CPC ..... A45D 44/04; A45D 44/02; A45D 44/06; A45D 2020/126
See application file for complete search history.

(56) References Cited

U.S. PATENT DOCUMENTS 3,460,899 A * 8/1969 Miller ..... A45D 44/04 312/351
5,031,778 A * 7/1991 Edgecombe ..... A47F 7/00 248/176.1
5,615,782 A * 4/1997 Choe ..... A45D 44/02 211/60.1
6,109,446 A * 8/2000 Foote ..... A45D 1/04 219/242
10,413,069 B1 * 9/2019 Colon ..... A47C 7/622
2009/0008347 A1 * 1/2009 Bell ..... A47F 5/02 211/183
2009/0065661 A1 * 3/2009 Burk ..... A45D 20/12 34/239
2009/0184077 A1 * 7/2009 Curet ..... A45D 44/04 211/113

(Continued)

FOREIGN PATENT DOCUMENTS

DE 102019998359 * 6/2021
KR 200338765 * 1/2004

*Primary Examiner* — Rachel R Steitz
*Assistant Examiner* — Brianne E Kalach
(74) *Attorney, Agent, or Firm* — CIONCA IP Law P.C.

(57) ABSTRACT

Provided herein is a caddy organizer for hair styling tools, having a base having a flat surface along at least a portion of a bottom side of the base, exterior walls extending upwards from the flat surface, and interior walls within an interior of the base; at least three compartments within the base, wherein each compartment is separated from the other compartments of the base by the interior walls; at least one tray configured to fit into one compartment of the at least three compartments, wherein the at least one tray is removable from the compartment; at least two tool sleeves within the base; a belt along an exterior side of the base, the belt having a securing means; a first plurality of ventilation holes on the exterior walls of the base; and a second plurality of ventilation holes on each of the at least two baskets.

11 Claims, 9 Drawing Sheets

(56) References Cited

U.S. PATENT DOCUMENTS

| | | | | |
|---|---|---|---|---|
| 2011/0062039 | A1* | 3/2011 | Prokop | A45D 44/02 206/373 |
| 2012/0175372 | A1* | 7/2012 | Cooper | A45D 44/04 220/486 |
| 2017/0086586 | A1* | 3/2017 | Osweiler | H05K 5/0217 |

* cited by examiner

PORTABLE CADDY ORGANIZER

CROSS-REFERENCE TO RELATED APPLICATIONS

This application claims the benefit of U.S. Provisional Application No. 63/334,087, filed Apr. 23, 2022, which is hereby incorporated by reference, to the extent that it is not conflicting with the present application.

BACKGROUND OF INVENTION

1. Field of the Invention

The invention relates generally to devices and methods for storage, and more specifically to storage solutions for hair styling tools and accessories.

2. Description of the Related Art

Currently, there exist some solutions for organizing and storing tools such as hairstyling tools. Some of these solutions attempt to address organizing, storage, and portability issues relating to efficiency of access to such tools. However, these solutions fail to completely meet the needs of the industry as growth, change, and the need for versatility within the industry require suitable multifunctional hairstyling tool storage, access, and portability options to optimizing the hair styling experience. Some solutions attempt to establish stationary options for organizing hair styling tools, but these solutions are unable to meet the needs of the industry because they are often restrictive, bulky, and/or impede the styling process in some way. Some solutions seek to provide storage solutions for bulky or larger tools, but these solutions fail to meet industry needs because they fail to effectively account for the needs of hair stylists who require portable, versatile storage solutions. Therefore, there is a need for a solution to these problems.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

Provided herein are devices and methods for a portable belted caddy organizer, also referred to herein as a "portable caddy organizer," "caddy," or "caddy organizer." The devices provided herein can be used for attached to items such as, but not limited to, tripods, tables, chairs, mannequins, and any other suitable objects, such as stationary objects. The portable caddy organizers provided herein can help to establish a more efficient option for transporting, storing, organizing, and accessing tools such as, but not limited to, hair styling tools and accessories.

The caddy organizers provided herein may comprise a belted strap (also referred to herein as a belt or strap), fastener, basket, tooling sleeve, and any other suitable additional tooling compartments. In some embodiments, the caddy organizers may comprise legs, a leg stand, wheels, and so on, for increasing portability. The caddy organizers provided herein may comprise a plurality of pockets, baskets, sleeves, and so on, which may be referred to herein collectively as an organizing system, for assisting the hair stylist using the caddy organizers and streamlining the hairstyling experience. The caddy organizers provided herein may be durable for secure and prolonged use. In some embodiments, the belt of the caddy serves to attach and detach the caddy organizer to a desired object. It should be understood that the caddy organizers disclosed herein may also be provided with any other securing or fastening means such that the caddy organizer can be attached to and detached from a desired object. In some embodiments, the desired object is a stationary object, such as, but not limited to, a tripod, pole, chair, bench, and so on.

The belt may support the tool sleeves and the tool storage baskets, and other storage components of the organization system. Additionally, the caddy organizers disclosed herein provide a benefit over existing systems in that the belt may also serve as a handle to quickly and easily transition the caddy organizer into a portable device, such that the user can quickly and easily transport the caddy. In some embodiments, the sleeves and the tool baskets may connect to the belt.

The caddy organizers provided herein may comprise belting mechanisms or fasteners designed to attach to objects for allowing a user to access tools in a quicker and more seamless manner than they may with other existing caddies. The caddy organizers provided herein may be attached to and detached from any suitable object.

In some embodiments, the caddy organizers provided herein comprise an organization system. The organization system may include any suitable pockets, sleeves, baskets, and compartments such as hook compartments for storage and easy access to hairstyling tools. In some embodiments, any one or more individual components of the organization system, such as a basket, compartment, or sleeve, may be attachable to and detachable from the caddy organizer.

In some embodiments, the caddy organizers provided herein comprise a collapsible and/or stackable design for increasing portability of the caddy organizers.

In some embodiments, any one or more elements of the caddy organizers provided herein may be constructed from durable, flexible, and easily cleanable materials. Such materials may include, but are not limited to, plastic, mesh, polyester, vinyl, nylon, silicone, aluminum, and steel. It should be understood that the materials used to construct the caddy organizer may be altered to optimize portability and organizational efficiency.

In some embodiments, the caddy organizers provided herein may be used without a basket. In such embodiments, the belt may be fastened to a desired object, and tools and accessories can then be placed in various compartments of the organization system.

In some embodiments, a method of using any of the caddy organizers provided herein comprises fastening a belted strap to a desired object, storing tools in the caddy organizer tooling sleeves and baskets, retrieving tools and accessories from the caddy organizer during hairstyling, and returning the tools and accessories to the caddy organizer during or after hairstyling. The methods provided herein may streamline the hairstyling process by providing a user such as a hairstylist with a simple, portable, and accessible hair tool and accessory organizing option for quick and efficient hair styling experiences.

Provided herein is a caddy organizer for hair styling tools, comprising: a base having a flat surface along at least a portion of a bottom side of the base, exterior walls extending upwards from the flat surface, and interior walls within an interior of the base; at least three compartments within the base, wherein each compartment is separated from the other compartments of the base by the interior walls; at least one tray configured to fit into one compartment of the at least three compartments, wherein the at least one tray is removable from the compartment; at least two tool sleeves within the base; a belt along an exterior side of the base, the belt having a securing means; a first plurality of ventilation holes on the exterior walls of the base; and a second plurality of ventilation holes on each of the at least two baskets.

Provided herein is a caddy organizer for hair styling tools, comprising: a base having a flat surface along at least a portion of a bottom side of the base, exterior walls extending upwards from the flat surface, and interior walls within an interior of the base; at least two cutouts on the exterior walls, wherein each one of the cutouts comprise two vertical slits, each vertical slit providing an open space on the bottom side of the base, and having a portion of the exterior walls in between the two vertical slits; at least three compartments within the base, wherein each compartment is separated from the other compartments of the base by the interior walls; at least one tray configured to fit into one compartment of the at least three compartments, wherein the at least one tray is removable from the compartment; at least two tool sleeves within the base, wherein the flat surface does not extend along a bottom side of the at least two tool sleeves; at least two baskets configured to fit into the tool sleeves, wherein each basket extends below the flat surface of the base; a belt along an exterior side of the base, the belt having a securing means; a first plurality of ventilation holes on the exterior walls of the base; and a second plurality of ventilation holes on each of the at least two baskets.

Provided herein is a method of using a caddy organizer for storing and organizing hair styling tools, wherein the caddy organizer comprises: a base having a flat surface along at least a portion of a bottom side of the base, exterior walls extending upwards from the flat surface, and interior walls within an interior of the base; at least two cutouts on the exterior walls, wherein each one of the cutouts comprise two vertical slits, each vertical slit providing an open space on the bottom side of the base, and having a portion of the exterior walls in between the two vertical slits; at least three compartments within the base, wherein each compartment is separated from the other compartments of the base by the interior walls; at least one tray configured to fit into one compartment of the at least three compartments, wherein the at least one tray is removable from the compartment; at least two tool sleeves within the base, wherein the flat surface does not extend along a bottom side of the at least two tool sleeves; at least two baskets configured to fit into the tool sleeves, wherein each basket extends below the flat surface of the base; a belt along an exterior side of the base, the belt having a securing means; a first plurality of ventilation holes on the exterior walls of the base; and a second plurality of ventilation holes on each of the at least two baskets; the method comprising: opening the securing means of the belt; securing the belt around a desired object; closing the securing means of the belt around the desired object such that the caddy organizer is secured to the desired object; placing at least one hair styling tool into the base; removing the at least one hair styling tool from the base when the at least one hair styling tool is needed during a hair styling session; and returning the at least one hair styling tool into the base.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
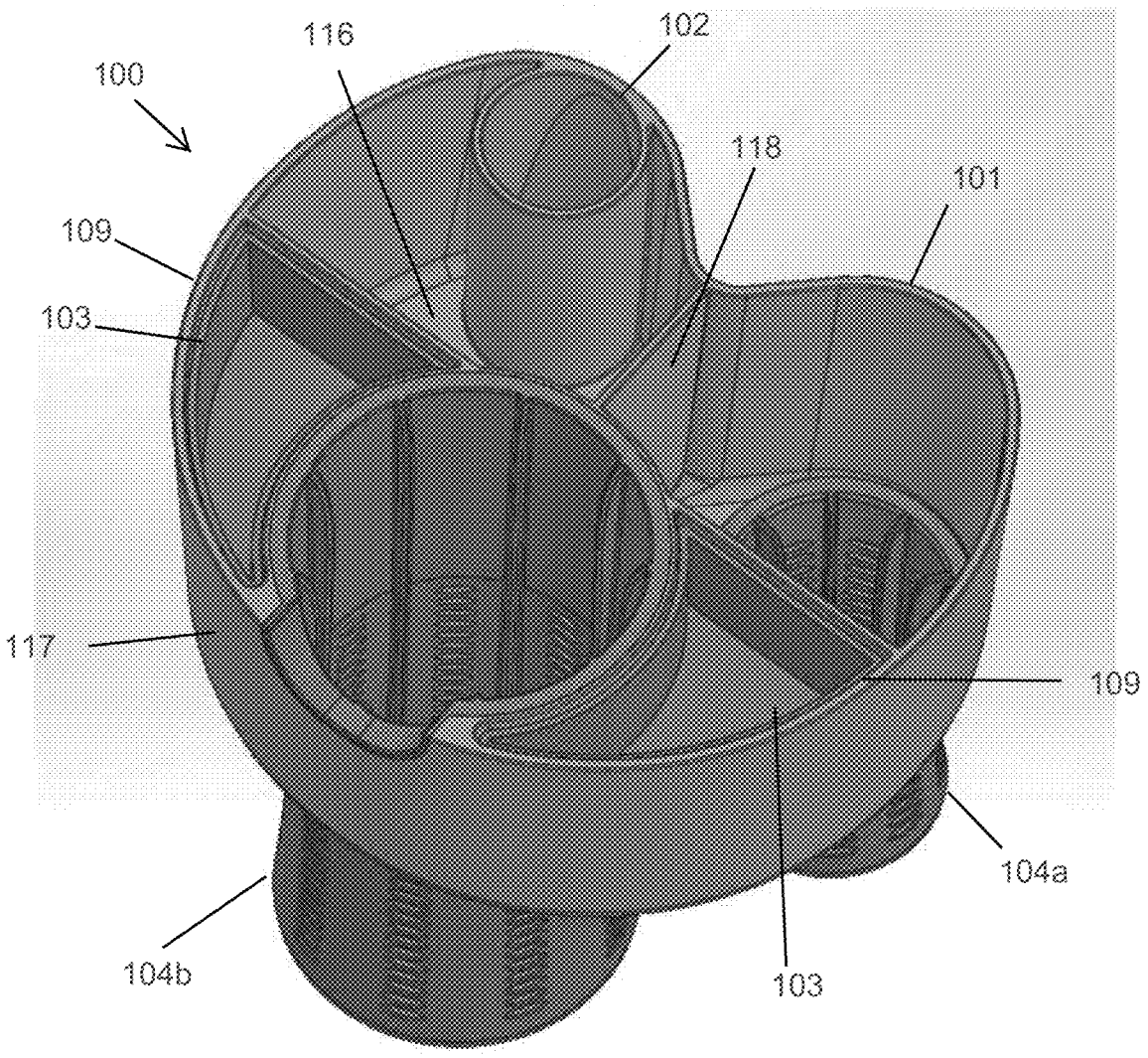
FIG. 1 depicts a top, front perspective view of a caddy organizer, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 105 and 205, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 depicts a top, front perspective view of a caddy organizer 100, according to an aspect. As shown as an example, a caddy organizer 100 may comprise a base 101 within which various compartments can be built in or removably housed. The base 101 may be flat on the bottom and have sides or walls extending upwards from the flat bottom for holding various components and tools. For example, the base 101 may comprise a tool sleeve 102, for receiving hairstyling tools, a plurality of trays 103, and baskets 104*a* and 104*b*. The trays 103 may fit into the compartments 109 of the base 101. The baskets may be provided in different sizes to accommodate different types of hairstyling tools or accessories. For example, a first basket 104*a* may be smaller in length and diameter than a second basket 104*b*. In some embodiments, the caddy organizers provided herein comprise one or more heat-resistant baskets such as the baskets shown as 104*a* and 104*b*, such that hairstyling tools which use heat may safely be stored in the baskets. Each basket may extend downwards below the base 101 in order to accommodate longer or larger hair styling tools, for example.

In some embodiments, the base 101 comprises a flat surface 116 along at least a portion of a bottom side of the base. In some embodiments, the base 101 comprises exterior walls 117 extending upwards from the flat surface 116, and interior walls 118 within an interior of the base. In such embodiments, each of the compartments of the caddy organizer is separated from the other compartments by the interior walls 118.

Figure 2:
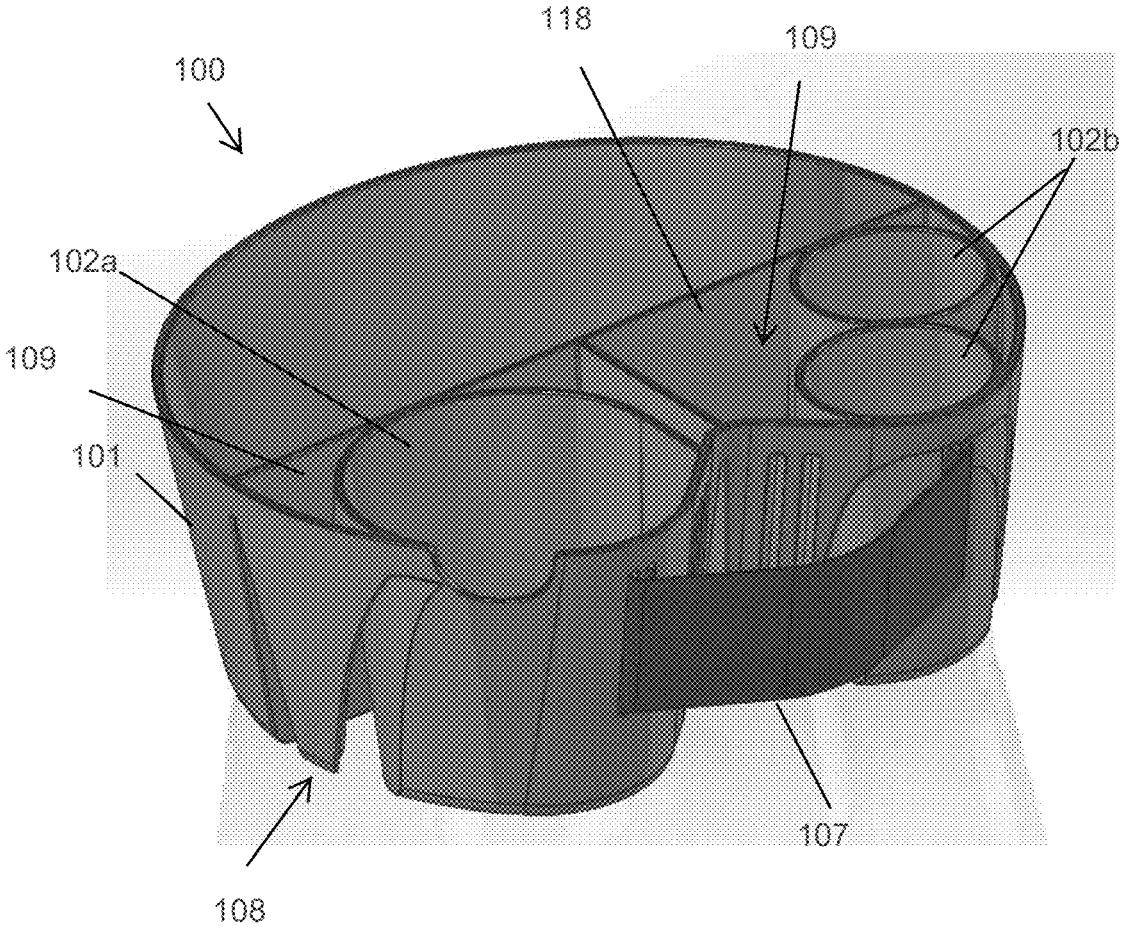
FIG. 2 depicts a rear perspective view of a caddy organizer having a belt, according to an aspect.

FIG. 2 depicts a rear perspective view of a caddy organizer 100 having a belt 107, according to an aspect. The belt 107, also referred to herein as a fastener or strap, may be provided with any suitable belting mechanism, fastening means, or securing means such that the caddy organizer 100 can be attached to and detached from other objects. It should be understood that any of the caddy organizers disclosed herein may be provided with a belt 107.

Provided herein are methods for using any of the caddy organizers disclosed herein. In some embodiments, the methods comprise opening the securing means of the belt; securing the belt around a desired object; closing the securing means of the belt around the desired object such that the caddy organizer is secured to the desired object; placing at least one hair styling tool into the base; removing the at least one hair styling tool from the base when the at least one hair styling tool is needed during a hair styling session; and returning the at least one hair styling tool into the base. In some embodiments, the hair styling tool is a heat styling tool, and the caddy organizer comprises at least two baskets, wherein the at least two baskets are constructed from a heat resistant material; and the placing step comprises placing the heat styling tool into one basket of the at least two baskets. In some embodiments, the methods disclosed herein comprise removing the belt from the desired object; and removing the caddy organizer from the desired object.

As shown as an example, the caddy organizer 100 of FIG. 2 is shown having a large tool sleeve 102*a* and two small tool sleeves 102*b*. In some embodiments, the tool sleeves are provided with a flat bottom such that tools can be stored within the tool sleeves. In some embodiments, the tool sleeves are provided without a bottom such that baskets can be inserted into the tool sleeve. Also shown in FIG. 2 is another example of the interior walls 118 separating the compartments 109 of the caddy organizer.

In some embodiments, the caddy organizers disclosed herein are provided with cutouts 108, also referred to herein as slits or cutaways. The cutouts 108 may be provided on one or more portions of the base 101. The cutouts 108 may allow for the caddy organizer to be stackable on other caddy organizer units. It should be understood that the caddy organizers disclosed herein may be constructed such that they are stackable with other caddy organizers by having the cutouts 108, or even without having cutouts 108.

Figure 3A:
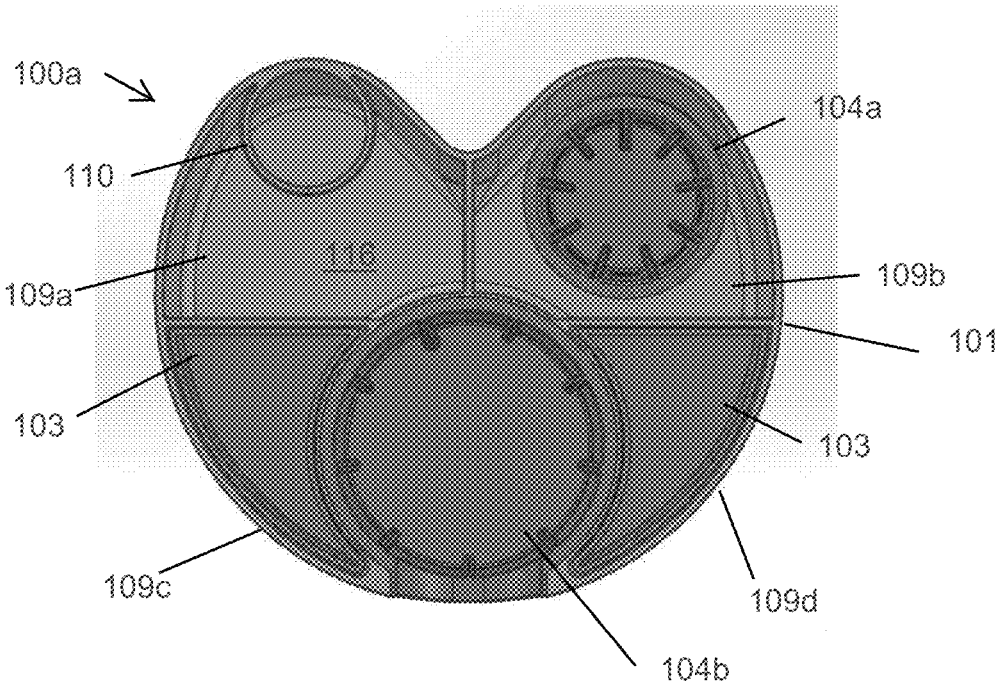
FIGS. 3A-3B depict top plan views of a caddy organizer having a first example of an organization system, and a caddy organizer having a second example of an organization system, according to an aspect.
Figure 3B:
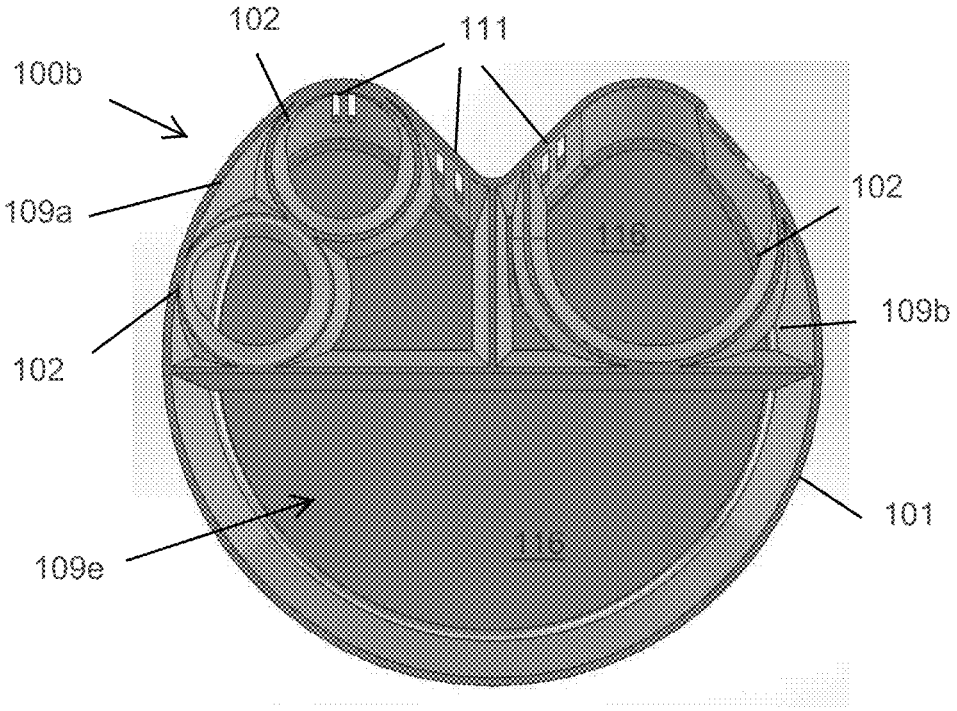

FIGS. 3A-3B depict top plan views of a caddy organizer 100*a* having a first example of an organization system, and a caddy organizer 100*b* having a second example of an organization system, according to an aspect. It should be understood that the caddy organizers disclosed herein may be provided with any suitable arrangement and numbers of trays, baskets, or any other types of organizing compartments, as will be discussed further herein.

As shown as a first example, a first caddy organizer 100*a* is shown with a top left compartment 109*a*, a top right compartment 109*b*, a bottom left compartment 109*c* fitted with a tray 103, a bottom right compartment 109*d* fitted with a tray 103. The top left compartment 109*a* comprises a ring holder 110 for accessories or tools to be hooked or placed into. The caddy organizer 100*a* also comprises a bottom center basket 104*b* and a basket 104*a* within the top right compartment. The basket 104*a* may be fitted into a tool sleeve of the caddy organizer 100*a*, wherein the tool sleeve does not have a bottom such that the basket can extend below the flat bottom 116 of the base, such as the example shown and described herein when referring to FIG. 4. Similarly, the basket 104*b* may be fitted into a tool sleeve of the caddy organizer 100*a*, wherein the tool sleeve does not have a bottom such that the basket can be extend below the flat bottom 116 of the base.

As shown as a second example, a second caddy organizer 100*b* is shown with a top left compartment 109*a*, a top right compartment 109*b*, and a bottom compartment 109*e*. The top left compartment 109*a* and the top right compartment 109*b* each comprise tool sleeves 102 of various sizes. In some embodiments, the flat bottom 116 of the base 101 extends throughout the entirety of the base and is included along the bottom of the tool sleeves 102.

In some embodiments, the caddy organizers disclosed herein comprise ventilation holes 111. The ventilation holes 111 may be useful dissipating heat from hair styling tools that use heat which are then stored in the caddy organizer. In some embodiments, ventilation holes are provided in the base 101. In some embodiments, ventilation holes are provided in the baskets of the organization system.

Figure 4:
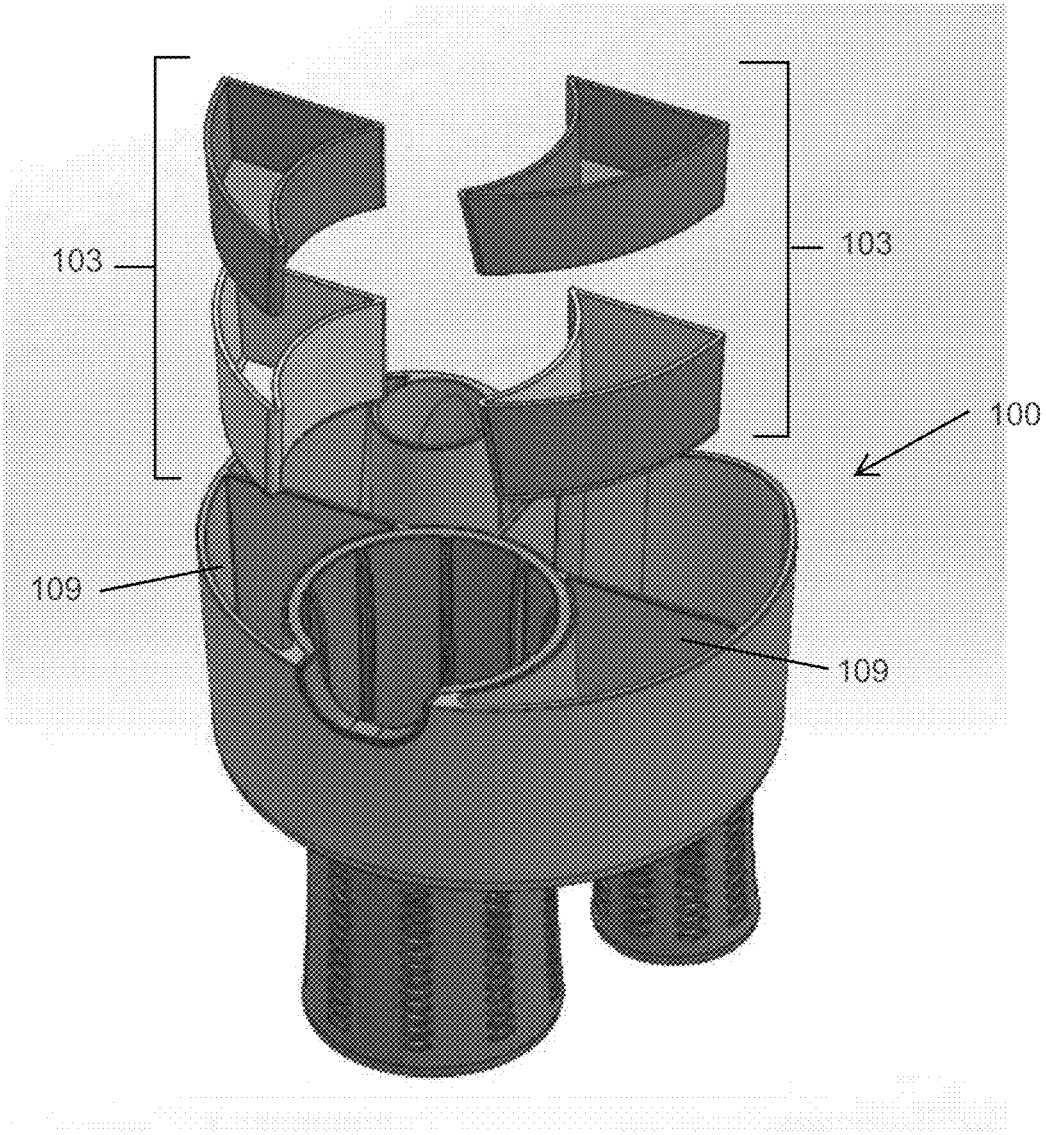
FIG. 4 depicts a partially exploded side perspective view of a caddy organizer, showing the caddy organizer having stackable trays 103, according to an aspect.

FIG. 4 depicts a partially exploded side perspective view of a caddy organizer 100, showing the caddy organizer having stackable trays 103, according to an aspect. As shown, the caddy organizers disclosed herein may be provided with compartments 109 within which trays 103 can be inserted and stacked.

In some embodiments, the caddy organizers disclosed herein comprise at least two trays. In some embodiments, the caddy organizers disclosed herein comprise at least four trays. In some embodiments, at least two trays are provided and are configured to fit into one compartment of the caddy organizer, wherein the at least two trays are configured to be nested on top of each other.

Figure 5A:
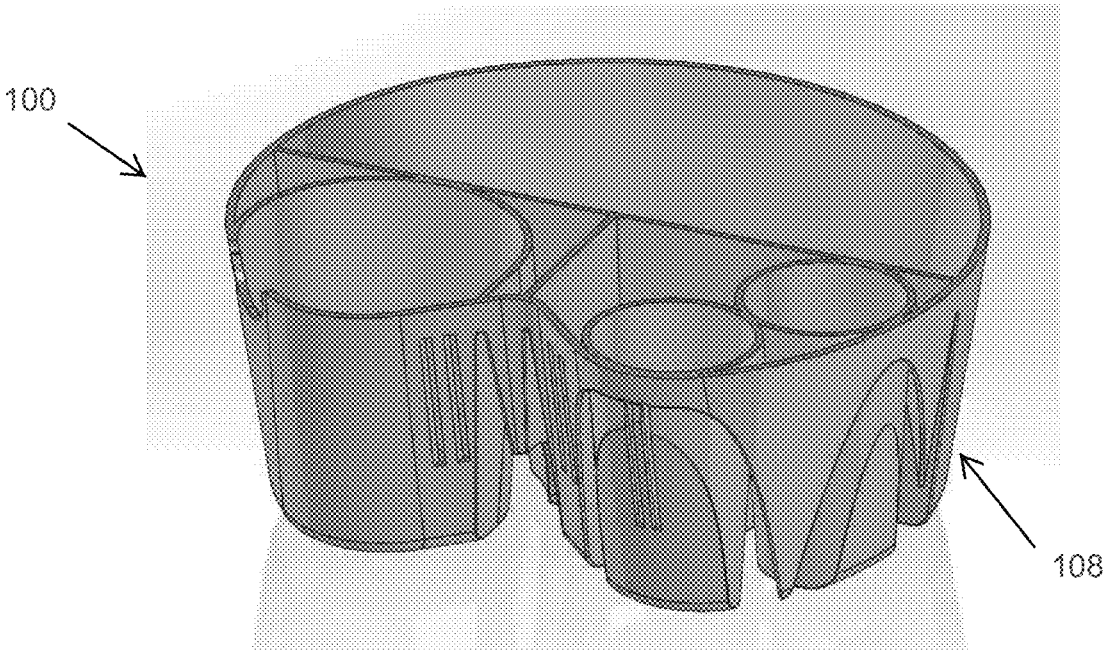
FIGS. 5A-5B depict a top, side perspective view, and a bottom view, respectively, of a caddy organizer having cutouts 108, according to an aspect.
Figure 5B:
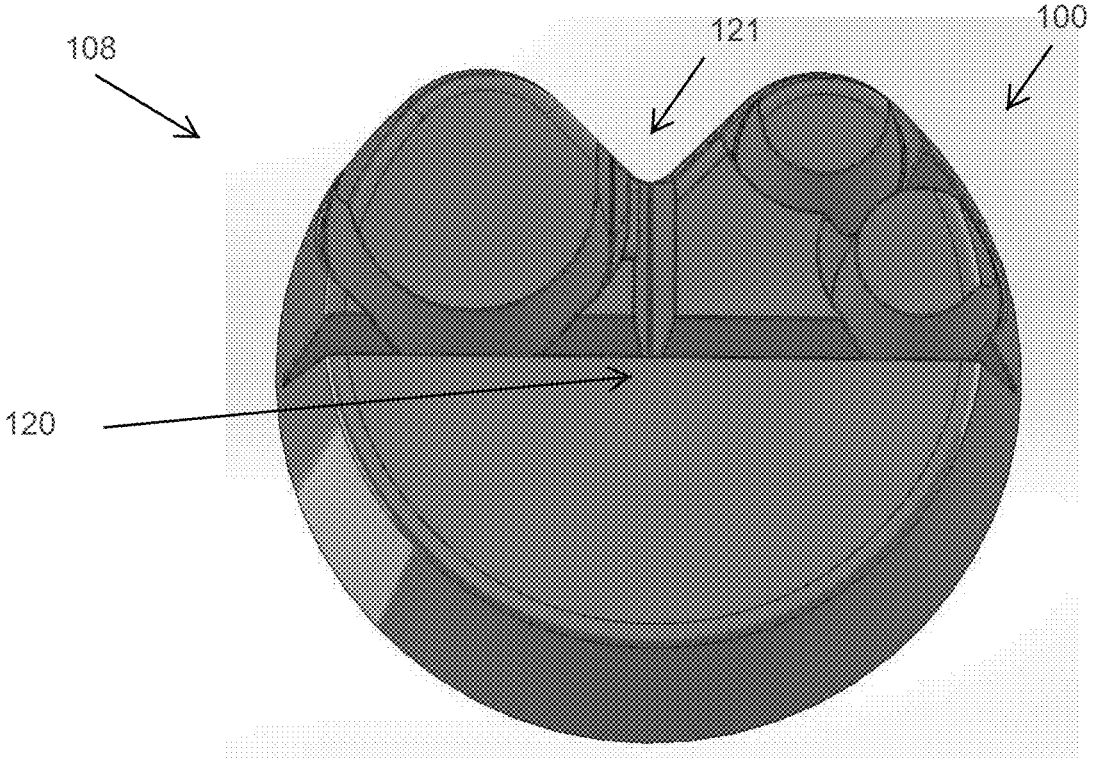

FIGS. 5A-5B depict a top, side perspective view, and a bottom view, respectively, of a caddy organizer 100 having cutouts 108, according to an aspect. The cutouts 108, as discussed herein, may assist a user in stacking multiple caddy organizers or removing a caddy organizer from a stack. As was also discussed herein, it should be understood that any of the caddy organizers disclosed herein may be constructed to be stackable even without having cutouts 108. In some embodiments, the caddy organizers disclosed herein are constructed such that they can be nested or stacked. In such embodiments, the exterior walls of the base 101 may extend upwards from the bottom surface of the base in an outward, tapered manner, away from a center point 120 of the base, such that the caddy organizers can be nested into other caddy organizers.

In some embodiments, the caddy organizers disclosed herein comprise rounded edges along the exterior walls, and wherein a portion 121 of the exterior walls curves inwards towards a center point 120 of the base.

Figure 5C:
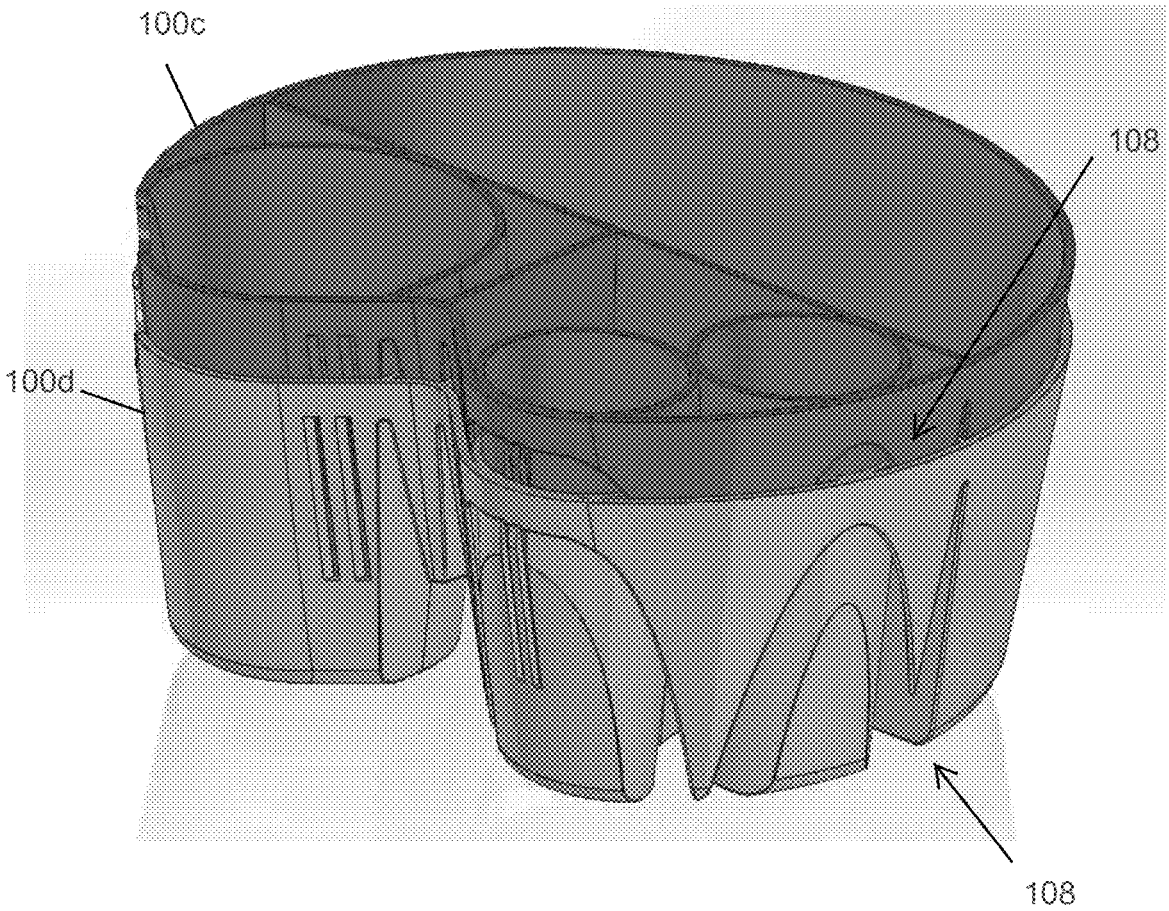
FIG. 5C depicts a side perspective view of a first caddy organizer stacked and nested into a second caddy organizer, according to an aspect.

FIG. 5C depicts a side perspective view of a first caddy organizer 100*c* stacked and nested into a second caddy organizer 100*d*, according to an aspect. The caddy organizers 100*c* and 100*d* each are provided with cutouts 108 for stacking.

Figure 6A:
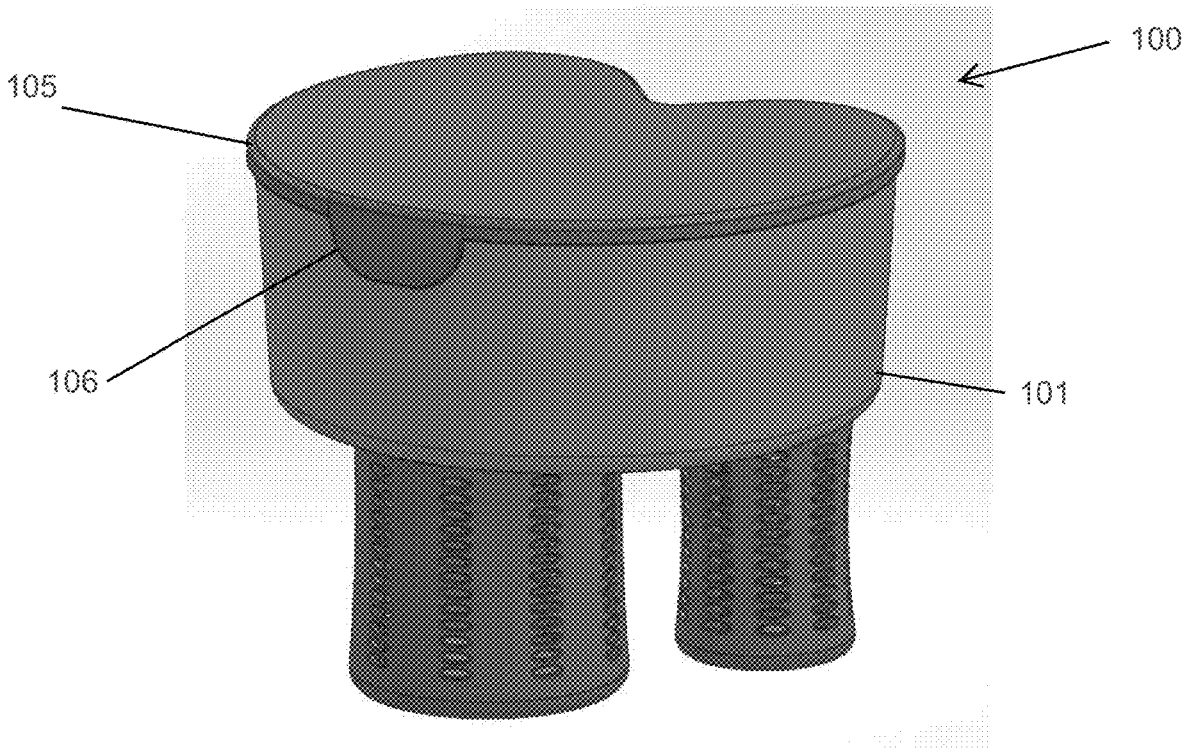
FIGS. 6A-6B depict a side perspective view and a top view, respectively, of a caddy organizer having a lid and shown in a closed state, according to an aspect.
Figure 6B:
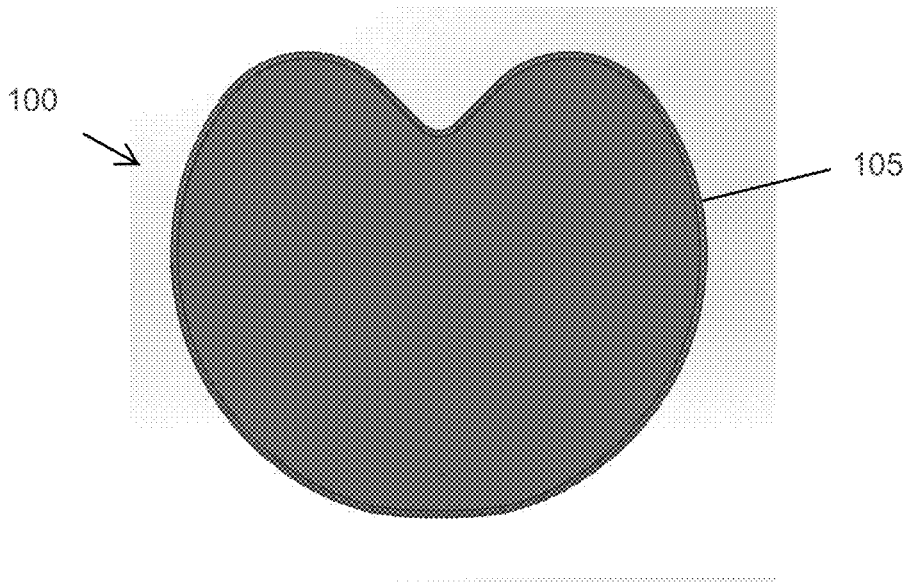

FIGS. 6A-6B depict a side perspective view and a top view, respectively, of a caddy organizer 100 having a lid 105 and shown in a closed state, according to an aspect. The lid 105 may comprise one or more lid fasteners 106 for securing the lid onto the base 101.

Figure 7A:
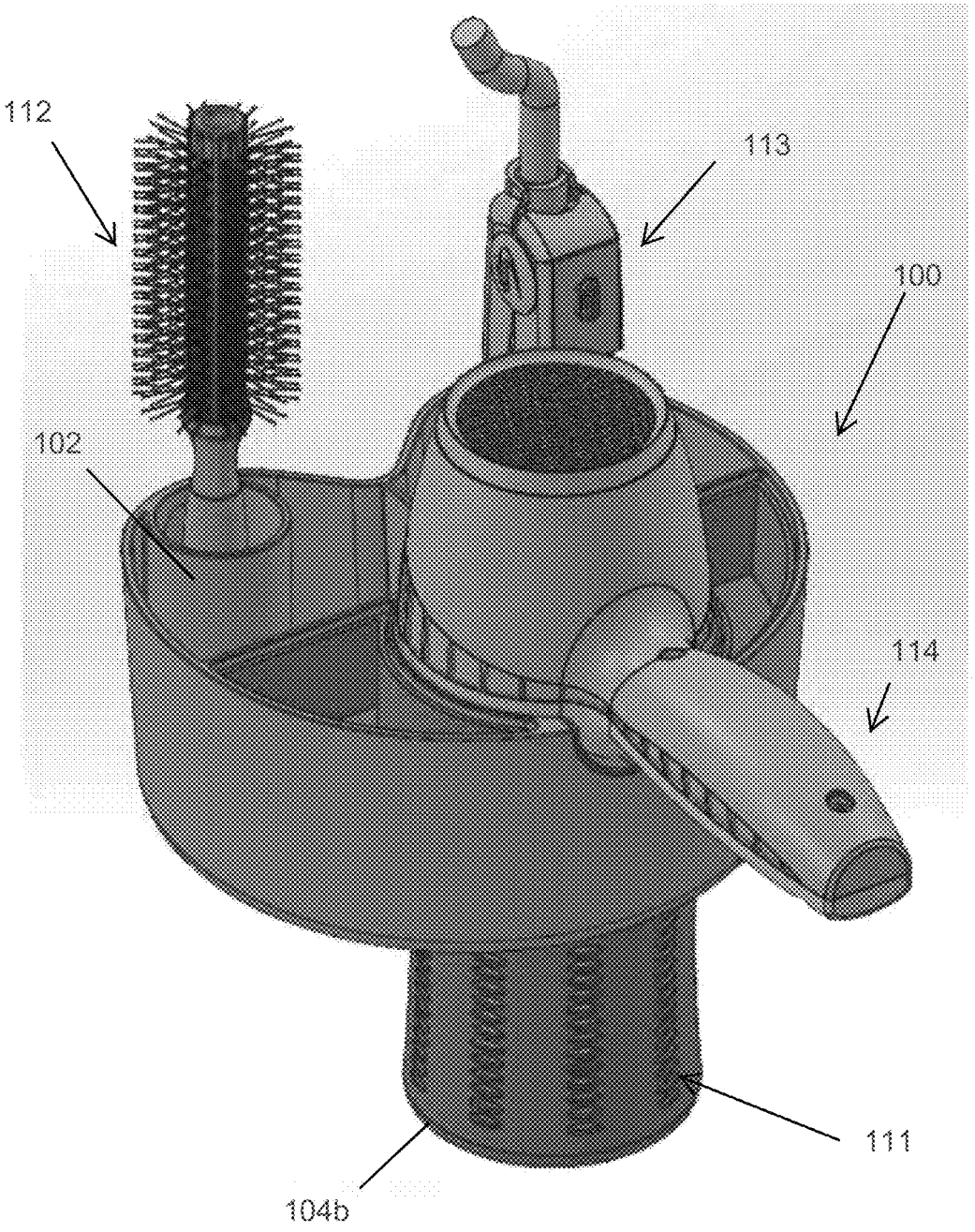
FIGS. 7A-7B depict a first side perspective view and a second side perspective view, respectively, of a caddy organizer in use, according to an aspect.
Figure 7B:
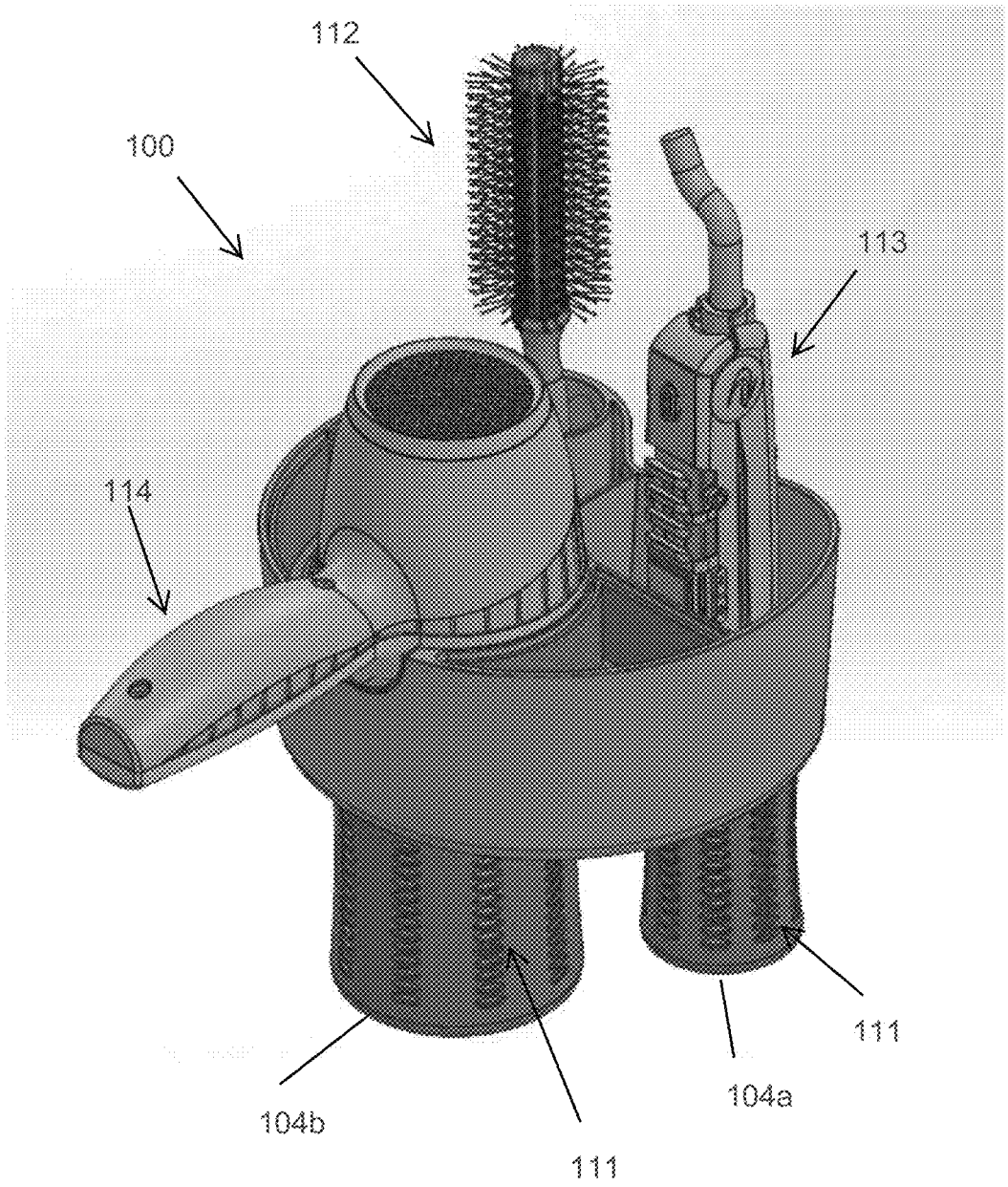

FIGS. 7A-7B depict a first side perspective view and a second side perspective view, respectively, of a caddy organizer 100 in use, according to an aspect. As shown as an example, tools such as a hairbrush 112 may be stored in a tool sleeve 102. Heat styling tools such as a flat iron 113 and a blow dryer 114 may be stored in baskets 104*a* and 104*b*. The baskets may be heat resistant and may be provided with ventilation holes 111.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A caddy organizer for hair styling tools, comprising:

a base having a flat surface along at least a portion of a bottom side of the base, exterior walls extending upwards from the flat surface, and interior walls within an interior of the base;

at least two cutouts on the exterior walls, wherein each one of the cutouts comprise two vertical slits, each vertical slit providing an open space on the bottom side of the base, and having a portion of the exterior walls in between the two vertical slits;

at least three compartments within the base configured to receive the hair styling tools, wherein each compartment is separated from the other compartments of the base by the interior walls;

wherein each one of the interior walls extends up towards an open top side of the base, such that each one of the interior walls is coplanar with each of the other interior walls along the open top side, such that the hair style tools received into each one of the at least three compartments are accessible from the open top side without obstructing any of the other at least three compartments;

at least one tray configured to fit into one compartment of the at least three compartments, wherein the at least one tray is removable from the compartment;

at least two tool sleeves within the base, wherein the flat surface does not extend along a bottom side of the at least two tool sleeves;

at least two baskets configured to fit into the tool sleeves, wherein each basket extends below the flat surface of the base;

a belt along an exterior side of the base oriented such that the belt extends horizontally along the exterior side of the base, and such that the belt is configured to wrap horizontally around a vertically extending desired object, the belt having a securing means;

a first plurality of ventilation holes on the exterior walls of the base; and a second plurality of ventilation holes on each of the at least two baskets.

2. The caddy organizer of claim 1, wherein at least two trays are configured to fit into the one compartment of the at least three compartments, and wherein the at least two trays are configured to be nested on top of each other.

3. The caddy organizer of claim 1, wherein the at least two baskets are constructed from a heat resistant material.

4. The caddy organizer of claim 1, comprising a lid covering a top side of the base.

5. The caddy organizer of claim 1, comprising rounded edges along the exterior walls, and wherein a portion of the exterior walls curves inwards towards a center point of the base.

6. The caddy organizer of claim 1, wherein the caddy organizer is constructed such that the base is capable of being nested into a second caddy organizer.

7. A method of using a caddy organizer for storing and organizing hair styling tools, wherein the caddy organizer comprises:

a base having a flat surface along at least a portion of a bottom side of the base, exterior walls extending upwards from the flat surface, and interior walls within an interior of the base;

at least two cutouts on the exterior walls, wherein each one of the cutouts comprise two vertical slits, each vertical slit providing an open space on the bottom side of the base, and having a portion of the exterior walls in between the two vertical slits;

at least three compartments within the base, wherein each compartment is separated from the other compartments of the base by the interior walls;

wherein each one of the interior walls extends up towards an open top side of the base, such that each one of the interior walls is coplanar with each of the other interior walls along the open top side, such that the hair style tools received into each one of the at least three compartments are accessible from the open top side without obstructing any of the other at least three compartments;

at least one tray configured to fit into one compartment of the at least three compartments, wherein the at least one tray is removable from the compartment;

at least two tool sleeves within the base, wherein the flat surface does not extend along a bottom side of the at least two tool sleeves;

at least two baskets configured to fit into the tool sleeves, wherein each basket extends below the flat surface of the base;

a belt along an exterior side of the base oriented such that the belt extends horizontally along the exterior side of the base, and such that the belt is configured to wrap horizontally around a vertically extending desired object, the belt having a securing means;

a first plurality of ventilation holes on the exterior walls of the base; and a second plurality of ventilation holes on each of the at least two baskets; the method comprising:

opening the securing means of the belt;

securing the belt around a desired object;

closing the securing means of the belt around the desired object such that the caddy organizer is secured to the desired object;

placing at least one hair styling tool into the base;

removing the at least one hair styling tool from the base when the at least one hair styling tool is needed during a hair styling session;

returning the at least one hair styling tool into the base;

removing the belt from the desired object; and removing the caddy organizer from the desired object.

8. The method of claim 7, wherein the caddy organizer comprises a lid covering a top side of the base; the method further comprising opening the lid to access the at least one hair styling tool inside the interior of the base; and closing the lid to secure the at least one hair styling tool within the interior of the base.

9. The method of claim 7, wherein the at least one hair styling tool is a heat styling tool; wherein the at least two baskets are constructed from a heat resistant material;

and wherein the placing step comprises placing the heat styling tool into one basket of the at least two baskets.

10. The method of claim 7, wherein the caddy organizer comprises rounded edges along the exterior walls, and wherein a portion of the exterior walls curves inwards towards a center point of the base.

11. The method of claim 7, wherein the caddy organizer is constructed such that the base is capable of being nested into a second caddy organizer.

* * * * *